US006048486A

United States Patent [19]

Fels et al.

[11] Patent Number: 6,048,486

[45] **Date of Patent: *Apr. 11, 2000**

[54] PROCESS FOR FORMING CONTOURS IN ARAMIDE FLAT STRUCTURES

[75] Inventors: Achim Fels; Jörg Wintersieg; Michael Mohr, all of Wuppertal; Dieter Holzhauer, Heubach; Franz Palzer, Heubach-Lautern, all of Germany

[73] Assignees: Triumph International AG, Munich; Akzo Nobel Faser AG, Wuppertal, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,135

[22] PCT Filed: Jun. 3, 1995

[86] PCT No.: PCT/EP95/02116

§ 371 Date: Jan. 30, 1997

§ 102(e) Date: Jan. 30, 1997

[87] PCT Pub. No.: WO96/01406

PCT Pub. Date: Jan. 18, 1996

[30] Foreign Application Priority Data

Jul. 1, 1994 [DE] Germany ..... 44 23 194

[51] Int. Cl.[7] ..... F41H 1/02; F41H 1/08; B29C 51/08; B29C 51/14

[52] U.S. Cl. ..... 264/324; 264/153; 264/258; 264/322; 2/2.5; 2/6.6; 2/410; 2/463; 428/911; 425/395; 425/398

[58] Field of Search ..... 264/324, 257, 264/258, 153, 322; 2/2.5, 410, 6.6, 463; 428/911; 425/395, 398

[56] References Cited

U.S. PATENT DOCUMENTS

| | | | |
|---|---|---|---|
| 2,190,807 | 2/1940 | Steinberger | 264/324 |
| 2,285,967 | 6/1942 | Hardy | 264/324 |
| 2,616,084 | 11/1952 | Shearer | 264/324 |
| 2,867,889 | 1/1959 | Thompson, Jr. | 264/324 |
| 2,893,396 | 7/1959 | Thompson, Jr. | 264/324 |
| 2,960,424 | 11/1960 | Bjorholm . | |
| 3,070,870 | 1/1963 | Alexander et al. | 264/324 |
| 3,348,549 | 10/1967 | Brodmann et al. | 264/324 |
| 3,502,083 | 3/1970 | Howard et al. | 264/324 |
| 3,527,858 | 9/1970 | Braxton et al. | 264/324 |
| 3,891,377 | 6/1975 | Howard | 264/324 |
| 3,891,996 | 7/1975 | Leach et al. | 2/2.5 |
| 3,956,447 | 5/1976 | Denommee et al. . | |
| 3,981,670 | 9/1976 | Levy | 264/324 |
| 4,013,750 | 3/1977 | Magidson et al. | 264/324 |
| 4,025,597 | 5/1977 | Sawamoto | 264/324 |
| 4,048,365 | 9/1977 | Hoover | 428/215 |
| 4,143,197 | 3/1979 | Jasionowicz et al. . | |
| 4,148,322 | 4/1979 | Jacaruso et al. | 264/324 |
| 4,181,768 | 1/1980 | Severin | 428/911 |
| 4,183,097 | 1/1980 | Mellian . | |
| 4,200,677 | 4/1980 | Bottini et al. . | |
| 4,288,268 | 9/1981 | Hartung | 156/245 |
| 4,309,487 | 1/1982 | Holmes . | |
| 4,375,445 | 3/1983 | Cole et al. | 264/258 |
| 4,457,985 | 7/1984 | Harpell et al. . | |
| 4,522,871 | 6/1985 | Armellino, Jr. et al. | 428/911 |
| 4,555,426 | 11/1985 | Roth et al. | 428/113 |
| 4,578,821 | 4/1986 | Zufle . | |
| 4,613,473 | 9/1986 | Layden et al. | 264/103 |
| 4,613,535 | 9/1986 | Harpell et al. | 428/113 |
| 4,639,387 | 1/1987 | Epel | 428/911 |
| 4,656,674 | 4/1987 | Medwell | 2/2.5 |
| 4,748,996 | 6/1988 | Combier | 264/324 |
| 4,778,638 | 10/1988 | White | 264/152 |
| 4,842,923 | 6/1989 | Hartman . | |
| 4,953,234 | 9/1990 | Li et al. . | |
| 5,020,157 | 6/1991 | Dyer . | |
| 5,080,851 | 1/1992 | Floc et al. | 264/324 |
| 5,108,530 | 4/1992 | Niebling, Jr. et al. | 156/245 |
| 5,203,940 | 4/1993 | Krone . | |
| 5,273,705 | 12/1993 | Sakamoto . | |
| 5,306,557 | 4/1994 | Madison . | |
| 5,512,348 | 4/1996 | Mazelsky | 2/2.5 |

(List continued on next page.)

FOREIGN PATENT DOCUMENTS

| | | |
|---|---|---|
| 288771-A2 | 11/1988 | European Pat. Off. . |
| 417827-A1 | 3/1991 | European Pat. Off. . |
| 1398150 | 3/1965 | France . |
| 2697626-A1 | 5/1994 | France . |
| 2 254 204 U | 5/1974 | Germany . |
| 3150858 | 6/1983 | Germany . |
| 3426458-A1 | 1/1986 | Germany . |
| 3614068 | 10/1987 | Germany . |
| 3743243 | 6/1989 | Germany . |
| 3938741 | 3/1991 | Germany . |
| 4140444-A1 | 6/1993 | Germany . |
| 1831302-A3 | 7/1993 | U.S.S.R. . |
| 2004165-C1 | 12/1993 | U.S.S.R. . |
| 1271461 | 4/1972 | United Kingdom . |
| 2069318 | 8/1981 | United Kingdom | 2/2.5 |
| 2144973 | 3/1985 | United Kingdom | 2/2.5 |
| 2231481 | 11/1990 | United Kingdom | 2/2.5 |
| WO 89/01124 | 2/1989 | WIPO . |

OTHER PUBLICATIONS

U.S. Armor Corportion Catalog, Jan. 24, 1994, pp. 1–20.

SPE Journal, May 1963, "*Deep Draw Bubble Forming Techniques For ABS Polymers*", David C. Deeds, pp. 471–474.

Journal (Melliand Textilberichte), vol. 67, No. 8, (1986), A.Heintze, *High–strength aramid fibres—their properties and applications*, pp. 529–532.

*Primary Examiner*—Jan H Silbaugh
*Assistant Examiner*—Michael I. Poe
*Attorney, Agent, or Firm*—Oliff & Berridge, PLC

[57] ABSTRACT

In a process for forming contours in aramide flat structures, in particular textile flat structures made from aramide fibers, contouring is performed by molding in a temperature range of 180–300° C. and a press pressure range of 4–8 bar (400–800 kPa). The flat structures contoured by molding are suited in particular for the manufacture of antiballistic women's protective clothing as well as of antiballistic helmets. The effectiveness against penetration of bullets and splinters is not affected by the molding process.

13 Claims, No Drawings

U.S. PATENT DOCUMENTS

| | | | |
|---|---|---|---|
| 5,514,457 | 5/1996 | Fels et al. | 2/2.5 |
| 5,536,553 | 7/1996 | Coppage, Jr. et al. | 2/2.5 |
| 5,578,358 | 11/1996 | Foy et al. | 428/104 |
| 5,619,748 | 4/1997 | Nelson et al. | 2/2.5 |
| 5,622,771 | 4/1997 | Chiou et al. | 2/2.5 |
| 5,635,288 | 6/1997 | Park | 2/2.5 |
| 5,677,029 | 10/1997 | Prevorsek et al. | 428/113 |
| 5,943,694 | 8/1999 | Moureaux et al. | 2/2.5 |
| 5,960,470 | 10/1999 | Bachner, Jr. | 2/2.5 |

PROCESS FOR FORMING CONTOURS IN ARAMIDE FLAT STRUCTURES

BACKGROUND OF THE INVENTION

1. Field of the Invention

The invention relates to a process for forming contours in aramide flat structures, in particular in textile flat structures made from aramide yarns.

2. Discussion of Related Art

Aramide fibers find application in a number of areas in which high strength, low flammability, or good antiballistic action are required. Especially important among these application areas are those serving to provide protection of persons from the impact of projectiles, splinters, and the like.

For example, bullet- and splinterproof vests are manufactured from multiple superimposed aramide-fiber woven fabrics. Such fabrics also are used in antiballistic helmets and in various applications in property protection.

Due to the increasing use of female security personnel, protective clothing must be provided that conforms optimally to female body contours. The solutions to this problem proposed in the prior art, such as are described in U.S. Pat. No. 4,183,097, GB-A 2,231,481, U.S. Pat. No. 5,020,157, or U.S. Pat. No. 4,578,821, are expensive to manufacture and moreover do not offer the wearing comfort required by female security personnel.

Aramide flat structures, in particular aramide-fiber woven fabrics, also are often used in antiballistic helmets. In this case, the shaping is performed in part by deep-drawing of the fabrics embedded in a matrix resin, such as is described in U.S. Pat. No. 3,956,447, for example. In such processes, the treatment conditions must be adjusted to the resin of the matrix. This means that, depending on the type of resin, work is performed at relatively low temperatures. Irreversible imparting of shapes in the antiballistic fabrics embedded in or impregnated by resin and forming the actual antiballistic protective layers usually cannot be achieved under these conditions.

A contouring process for aramide sheets and films is described in U.S. Pat. No. 5,273,705. Work is performed using a high quantity of a swelling agent, which enables contouring. This process is not only very expensive, but it also raises environmental concerns due to some of the swelling agents proposed.

SUMMARY OF THE INVENTION

The objective thus arose to provide a process permitting the contouring of aramide flat structures, particularly aramide-fiber woven fabrics, in a cost-effective manner without additional auxiliary agents, and exhibiting the same antiballistic effectiveness in the contoured areas as is provided in the uncontoured areas.

Surprisingly, it has been found that this objective can be met in a particularly advantageous manner if the contouring of aramide flat structures is performed by a molding process. In addition to enabling the cost-effective production of, for example, antiballistic protective clothing for women without sacrificing antiballistic effectiveness, the objective is satisfied in a particularly advantageous manner through the good body fit of the antiballistic materials provided by molding and the resulting increased wearing comfort.

DESCRIPTION OF PREFERRED EMBODIMENTS

Aramide flat structures are often used for antiballistic protective clothing. The aramides in this case usually are in the form of fibers that have been processed into textile flat structures, in particular woven fabrics. The term aromatic polyamide fibers is also common for such fibers, which are commercially available under the trade name Twaron®, for example.

Aramides are understood to be polyamides structured at least in part from aromatic compounds. In forming the polyamides, for example by polycondensation of acids or their chlorides with amines, both the acid and amine components can consist either wholly or in part of aromatic compounds. Within the scope of the invention, however, aramides are understood to also comprise polyamides in which only one of the two basic components is wholly or in part formed from aromatic compounds.

A well-known and particularly often used aramide in the fiber industry consists of p-phenylene terephthalamide, i.e., the acid component in this case is terephthalic acid, and the amine component is p-phenylene diamine.

The preferred aramide fibers for use in manufacturing antiballistic materials occur primarily as filament yarns. The titers of these yarns are normally between 400 and 3400 dtex. Although spun yarns can also be used, they provide less strength compared to filament yarns, forcing acceptance of a reduction in antiballistic effectiveness.

Aramide-fiber woven fabrics often are used in antiballistic protective clothing. The contouring in accordance with the invention, however, is not limited to the use of woven fabrics, since other textile and non-textile aramide flat structures such as sheets, knits, non-woven fabrics, thread composites, etc., can also be contoured using the inventive process. Textile flat structures are understood to be those made from fibers, such as woven fabrics, knits, non-woven fabrics, fiber composites, etc. Woven fabrics are preferred for conducting the process of the invention.

Molding, a process similar to deep-drawing, is well known in the foundation garment industry. The molding machines employed, also called molding presses, are also well known to one skilled in the art of the foundation garment industry.

Flat structures made from thermoplastic materials are particularly suitable for deep-drawing or molding. Aramides, however, are not in the thermoplastic category, since they exhibit no defined melting and softening points and decompose before melting. It was therefore especially surprising that the process of the invention was successful in contouring aramide flat structures such that a permanent new shape was achieved without sacrificing antiballistic effectiveness and that in this way irreversible contouring of, for example, the antiballistic layers of women's protective clothing was possible.

The essential part of a molding press is the mold. One skilled in the molding art understands this to be the apparatus provided for the shaping process, i.e., for shaping of a bust for women's clothing a form resembling the female breast and consisting of a positive and a negative part. The positive part is the part of the apparatus conforming to a breast shape, with a convex, i.e., outwardly curved, shape, while the negative part is concave, i.e., recessed or curved inward. The positive and negative parts are matched in size. Depending on the type of press, the positive or negative part is movable. The piece to be contoured is laid between the positive and negative parts and pressed into the form by raising or lowering the movable part of the press, thus imparting the desired shape.

The mold on molding presses is replaceable, so that a wide variety of shapes can be realized. In the case of women's protective clothing, the mold can be changed for shaping any desired size of breast.

Two of the major parameters in shaping on molding presses are the temperature and pressure during contouring. For aramide flat structures, a temperature range of 180–300° C. has proven advantageous. The preferred temperature range is 200–280° C., and the range 210–270° C. is especially preferred.

The pressure during contouring should be between 4 and 8 bar (400–800 kPa). The range from 5 to 7 bar (500–700 kPa) is preferred. These specifications refer to the pressure selected on the press. The effective pressure acting on the material being contoured is not measurable on molding presses.

Contouring can occur discontinuously or continuously. In the former method, for example, the aramide antiballistic layers intended for women's protective clothing are cut to size and then contoured individually on a molding press. In the same manner, contouring can also be performed on pieces from which the cutouts are made after the molding treatment.

The invention is not limited to the contouring of individual layers. Tests have shown that multiple layers can also be contoured simultaneously. This is possible up to 10 layers, whereby packages to be contoured have preferably up to 4 layers and most preferably 1 layer. By appropriate reconfiguration of the press, however, packages up to 20 layers can be contoured.

The term packages within the scope of the invention is understood to mean superimposed flat structures. These are not bonded to one another using a synthetic resin.

In addition to the discontinuous mode, a continuous mode is also possible when appropriate machinery, well-known in the molding industry, is available. In these presses, a length of woven fabric or other flat structure is fed to the mold and contoured at intervals. In the continuous mode, cutting to size usually occurs after shaping is completed.

As previously noted, it was surprising that the fabric properties in the contoured areas of aramide-fiber woven fabric are largely unchanged from those in the uncontoured locations. Tests have shown that the reduction in woven-fabric thickness due to contouring is insignificant. This is possibly attributable to the fact that the so-called take-up of the woven fabric is reduced by the contouring process. Take-up is understood to mean the ratio of the length of the yarn in the drawn state to the length of the yarn in the woven fabric, whereby numbers are with respect to the length of the drawn yarn. The required measurements and calculations are defined in German Industrial Standard DIN 53 852.

The largely unchanged properties of aramide-fiber woven fabrics after contouring are particularly evident in bombardment tests, in which the effectiveness of bullet- or splinter-proof clothing is determined.

In testing of protective action from bombardment with bullets, several superimposed layers of the material contoured on a molding press are bombarded. The number of layers is chosen to conform to the conditions prevalent in bullet-proof vests. Bombardment is conducted with 9 mm Para (FMJ) ammunition from a distance of 10 m at an angle of 90°. The test of antiballistic effectiveness comprises both detecting penetration of the structure and examining the changes in a plastilina mass positioned behind the material being bombarded. In the latter case, the depth of penetration of the projectile into the plastilina mass provides an approximate measure for the energy imparted by a projectile on the human body under bombardment. Penetration depths into the plastilina mass of up to 44 mm are permitted by police authorities, depending on specification.

The bombardment tests were conducted on aramide-fiber woven fabrics in which a bust had previously been formed on a molding press. The bombardment was directed to the contoured areas. Penetration of the structure was not noted in any of the tests conducted, as will be shown in the embodiment descriptions. The penetration depths into plastilina were between 26 and 42 mm and were thus under the maximum permissible limit.

The aramide flat structures contoured by the molding process are used preferably in the form of woven fabrics as antiballistic layers in women's bulletproof vests. The construction and manufacture of such bulletproof vests is described in patent application P 44 23 198.9, initially deposited with the German Patent Office concurrently with this application (corresponding to commonly owned U.S. application Ser. No. 08/765,134, filed concurrently herewith and incorporated herein by reference). The bombardment test results cited above, as well as the results given in the embodiment descriptions, show that the flat structures produced in accordance with the invention to serve as antiballistic layers for women's protective vests offer the same protection as antiballistic layers that were not subjected to contouring.

This also applies to women's splinter-protective vests, which are especially prevalent in military applications. To test the protective action required for such vests, a total of 14 layers of aramide-fiber woven fabrics, in which a bust had been contoured in accordance with the invention, were structured into a package and sewn together along the edges in preparation for the bombardment test. The resulting antiballistic package is subjected to a splinter bombardment as specified by STANAG 2920. The bombardment is conducted with 1.1 g splinters. The V50 value is determined, being the speed at which there is a 50% probability of penetration. Splinter-protective vests also require good antiballistic effectiveness in the wet state. For this reason, testing the protective action of materials for splinter-protective vests included determining the V50 value in the wet state.

The results of the bombardment tests show that the antiballistic effectiveness of aramide flat structures is not impaired by molding and that surprisingly the same protective action is provided at the locations modified by the molding process as at the locations not so modified. This proves the particular suitability of aramide flat structures, contoured by molding, for manufacturing bullet and splinter-proof protective clothing for women and for antiballistic helmets. The process of the invention also represents significant progress in the manufacture of protective clothing requiring fitting to body shapes. Without sacrificing protective action, the process of the invention can therefore be employed for the cost-effective production of protective clothing offering a high degree of wearing comfort, and in this respect offers a significant advantage compared to protective clothing manufactured using methods conventional up to now.

EXAMPLES

Example 1

Cutouts for protective vests were made from an aramide-fiber woven fabric employing yarns with a titer of 930 dtex, a weight of 202 g/m$^2$, and a thickness of 0.30 mm. In each of these cutouts individually, a bust was formed by molding. The temperature was 240° C., and the pressure of the press set to 6 bar (600 kPa). A total of 28 layers of these cutouts were structured into a package and sealed in a PVC jacket in which a bust had previously been contoured, also by molding. The resulting antiballistic package was subjected to a bombardment test conforming to the conditions cited above, whereby the bombardment was directed to the locations contoured into busts by the molding process. Of a total of 4 direct hits, none penetrated at these locations. The penetration depths into plastilina were between 28 and 37 mm. The German police specifications for use as protective clothing were thereby fully met.

Example 2

Example 1 was repeated, with molding taking place at a temperature of 210° C. and a selected press pressure of 5 bar (500 kPa). The bombardment test was conducted in the same manner as for Example 1 with 28 layers sealed in a PVC jacket. In this case as well, out of a total of 4 direct hits, none penetrated the locations contoured by molding. The penetration depths into plastilina were between 26 and 33 mm. The German police specifications for use as protective clothing were therefore also fully met in this test.

Example 3

Example 1 was repeated, with molding taking place at a temperature of 270° C. and a selected press pressure of 7 bar (700 kPa). The bombardment test was conducted in the same manner as for Example 1, with 28 layers sealed in a PVC jacket. In this case as well, out of a total of 4 direct hits, none penetrated the locations contoured by molding. The penetration depths into plastilina were between 33 and 42 mm. The German police specifications for use as protective clothing were therefore also fully met in this test.

Example 4

For further processing into splinter-protective vests, a woven fabric was produced from aramide-fiber yarns with a yarn titer of 1100 dtex, the fabric having a weight of 190 g/m$^2$ and a thickness of 0.30 mm. From this fabric, cutouts were prepared for splinter-protective vests. In each individual cutout, a bust was formed by molding. As in Example 1, the temperature was 240° C. and the press pressure was 6 bar (600 kPa). The cutouts were structured into a test package for splinter-protective vests. A total of 14 layers of these cutouts were structured into a package and sewn together along the edges for the bombardment test. The resulting antiballistic package thus formed was subjected to a splinter bombardment as specified by STANAG 2920, directed toward the molded locations. The bombardment was conducted with 1.1 g splinters. Bombardment of the package in the dry state resulted in a V50 value of 467 m/sec. The V50 value at the uncontoured locations was 466 m/sec. In bombardment in the wet state as well, practically the same values were noted in both the dry and wet states. The V50 value at the contoured locations was 437 m/sec and at the uncontoured locations 436 m/sec.

Example 5

An additional contouring test was conducted with cutouts from the woven fabric used in Example 4, whereby the conditions were analogous to Example 2 (temperature 210° C., press pressure 5 bar). The contoured fabric cutouts were processed into test packages for splinter-protective vests and subjected to splinter bombardment. V50 values at the contoured locations of 465 m/sec in the dry state and 437 m/sec in the wet state were obtained.

Example 6

In a further test, cutouts made from the fabric of Example 4 were contoured under the conditions of Example 3 (temperature 270° C., press pressure 7 bar). The fabric cutouts contoured under these conditions were structured into test packages for splinter-protective vests and subjected to splinter bombardment. V50 values at the contoured locations of 461 m/sec in the dry state and 432 m/sec in the wet state were obtained.

What is claimed is:

1. Process for forming irreversible contours in a textile aramide flat structure, comprising forming said textile aramide flat structure in the form of a single layer without additional auxiliary agents or in the form of a package of superimposed layers which are not joined together using a synthetic resin, and forming said irreversible contours in said textile aramide flat structure by pressing said textile aramide flat structure on a molding press between matching positive and negative parts of said molding press without additional auxiliary agents in a temperature range of 180–300° C. and at a press pressure range of 4–8 bar such that a new permanent shape having said irreversible contours is achieved in said textile aramide flat structure.

2. Process according to claim 1, wherein said pressing is conducted in a temperature range of 200–280° C.

3. Process according to claim 1, wherein said pressing is conducted in a temperature range of 210–270° C.

4. Process according to claim 1, wherein said pressing is conducted at a press pressure of 5–7 bar.

5. Process according to claim 1, wherein said textile aramide flat structure is woven fabric made from aramide fibers.

6. Process according to claim 1, wherein said pressing is conducted discontinuously on individual layers of said textile aramide flat structure.

7. Process according to claim 1, wherein said pressing is conducted discontinuously on said superimposed packages having 2–10 layers concurrently.

8. Process according to claim 1, wherein said pressing is conducted continuously.

9. Process according to claim 1, wherein said textile aramide flat structure is made from aramide fibers.

10. The process of claim 1, wherein said textile aramide flat structure is in the form of said single layer.

11. The process of claim 1, wherein said textile aramide flat structure is in the form of said package formed from 2 to 10 layers.

12. The process of claim 11, wherein said textile aramide flat structure is in the form of said package formed from 2 to 10 layers.

13. The process of claim 11, wherein said temperature range is 200–280° C.

* * * * *

UNITED STATES PATENT AND TRADEMARK OFFICE

CERTIFICATE OF CORRECTION

PATENT NO. : 6,048,486
DATED : April 11, 2000
INVENTOR(S) : Achim Fels; Jörg Wintersieg; Micheal Mohr; Dieter Holzhauer; and Franz Palzer It is certified that error appears in the above-identified patent and that said Letters Patent is hereby corrected as shown below:

Please amend the above-identified patent as follows:

Column 2,
Line 34, change "fiber" to -- thread --.

Claim 11,
Lines 2-3, change "2 to 10" to -- 2 to 4 --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*